United States Patent [19]

Coelho et al.

[11] Patent Number: 4,730,460

[45] Date of Patent: Mar. 15, 1988

[54] ULTRA - RAPID PLASMA FREEZING WITH HALOCARBON HEAT TRANSFER LIQUIDS

[75] Inventors: Philip H. Coelho; Victor Comerchero, both of Folsom, Calif.

[73] Assignee: Castleton, Inc., Rancho Cordova, Calif.

[21] Appl. No.: 12,196

[22] Filed: Feb. 9, 1987

[51] Int. Cl.[4] ..... F25D 17/02

[52] U.S. Cl. ..... 62/64; 62/114; 252/67

[58] Field of Search ..... 62/64, 114; 252/67

[56] References Cited

U.S. PATENT DOCUMENTS

| | | | |
|---|---|---|---|
| 2,841,965 | 7/1958 | Etherington | 62/513 |
| 3,576,650 | 4/1971 | Underwood et al. | 62/60 |
| 3,603,102 | 9/1971 | Banas | 62/64 |
| 3,729,947 | 5/1973 | Higuchi | 62/60 |
| 4,002,573 | 1/1977 | Hutchinson | 62/114 |
| 4,019,992 | 4/1977 | Kruger | 252/67 |
| 4,057,973 | 11/1977 | Murphy et al. | 62/114 |
| 4,057,974 | 11/1977 | Murphy et al. | 62/114 |
| 4,149,016 | 4/1979 | Toy et al. | 252/67 |
| 4,465,610 | 8/1984 | Enjo et al. | 252/67 |
| 4,680,939 | 7/1987 | Rojey et al. | 62/114 |

*Primary Examiner*—Ronald C. Capossela

[57] ABSTRACT

Ultra rapid freezing of thin wall containers, preferably plastic bags or bottles, of blood plasma by direct contact with a low freezing temperature liquid mixture of a chlorofluorocarbon (CFC 113) and at least one of a group of fluorocarbons minimizes migration of toxins in the heat transfer liquid to the plasma and improves the percentage yield of blood soluble protein fractions extracted from the frozen plasma in a subsequent freeze drying process.

7 Claims, No Drawings

ULTRA - RAPID PLASMA FREEZING WITH HALOCARBON HEAT TRANSFER LIQUIDS

BACKGROUND OF THE INVENTION

The present invention relates to the art of ultra rapid freezing of blood plasma and, more particularly, to the direct contact freezing of plasma in filled containers in which contamination of the plasma by migration of toxins in the heat transfer liquid to the plasma through the container walls is maintained at tolerable levels.

THE PRIOR ART

Conventional air freezers which require from three to six hours to lower the temperature of plasma in thin wall containers, typically plastic bags, from about 20° C. to −30° C., are ordinarily used for the freezing of blood plasma. Repeated opening and closing of the freezer doors results in excessive ice build up on the freezer coils from accumulation of ambient moisture in the air. The ice build up, which must be periodically removed, at a cost of heat buildup and significant electrical usage, together with the warming of the freezer chamber every time the door is opened and closed results in a necessarily inefficient and slow refrigeration process.

Direct contact heat transfer liquids such as liquid nitrogen and liquid carbon dioxide are well known and are used in extremely low temperature applications but require expensive equipment to maintain the liquid state of the coolant by the proper combination of pressure and low temperature to prevent evaporation and consequent loss of the vapor to atmosphere. For the economical freezing of plasma, the extreme low temperatures of liquid nitrogen and liquid carbon dioxide and attendant expense of the specialized equipment to handle it are not required.

As will be seen below, special refrigeration apparatus for use in handling the direct contact heat transfer liquids disclosed herein is not required nor is any particular type of chiller needed; however, suitable apparatus for immersion or spray contact of plasma in a heat transfer liquid will preferably have a relatively small chamber size and multiple freezing compartments so that repeated opening and closing of the small freezer doors does not expose the whole freezing chamber to ambient air. The inefficiency of conventional air freezers caused by ice buildup on the freezer coils can be eliminated if the freezer coils are not subject to contact by moisture laden air. For high efficiency, the coils will be submerged in a heat transfer liquid that is immiscible with water so that ice is not permitted to encase the coils.

It is also known that the percentage recovery of blood soluble proteins such as Factor 8, fibrinogin, fibronectin and AHF is adversely affected by delays in placing the plasma bags into the freezer and by prolonged freezing times since blood soluble proteins continue to decay until a temperature of about 30° C. is reached. Direct contact of the plasma bags with a heat transfer liquid to reduce the freezing time has heretofore not been thought commercially feasible since known heat transfer fluids which are operable in the liquid state were either too expensive to maintain in the liquid state due to the extreme low temperatures required for some, such as liquid nitrogen or liquid oxygen, or the liquids were considered too toxic for direct contact with plasma bags, or like alcohol, had other unacceptable characteristics such as flammability and miscibility with water.

Chlorofluorocarbon refrigerants such as the Freon (trademark of the Dupont Company) compositions, hereinafter referred to as CFC, have previously been employed in closed loop non-direct contact refrigeration systems in which the circulating refrigerant is never permitted to come into direct contact with the articles to be chilled. Toxins present in refrigerants of this type have prevented these refrigerants from being approved by regulatory authorities such as the United States Food and Drug Administration (FDA) for use for the intended purpose.

BRIEF DESCRIPTION OF THE DRAWING

FIG. 1 is a graph showing the freezing rates of plasma containers immersed in various direct contact heat transfer liquids.

FIG. 2 is a graph showing CFC (chlorofluorocarbon)113 concentration in plasma vs. temperature for a 45 minute immersion in a liquid mixture of CFC 113 and $C_6F_{14}$.

DETAILED DESCRIPTION OF THE INVENTION

For the purposes intended, a suitable heat transfer liquid preferably will have all of the following properties:

(a) a freezing point of at least as low as −30° C. so that the plasma bags can be sprayed with or immersed in a chilled liquid bath for the minimum amount of time to achieve the desired temperature reduction;

(b) a boiling point above ordinary ambient temperature, and preferably above 50° C., so that undue loss of heat transfer fluid to atmosphere through evaporation does not take place;

(c) be essentially colorless, odorless, nonflammable, and be non-toxic or be of such a nature that toxins present do not readily migrate through the bags to the plasma during the time of direct contact therewith;

(d) have good thermal conductivity;

(e) have a low viscosity and low surface tension so that excess liquid will readily drain off of the frozen plasma containers as they are removed from the liquid;

(f) be immiscible in water so that any unwanted water in the heat transfer liquid can easily be removed to prevent ice build up;

(g) be denser than water so that accumulated water will float as ice for easy removal; and (h) be non-reactive with inks used to mark the outside of plasma containers or bags.

Tests have been performed using the chlorofluorocarbon (CFC) composition Freon 113 alone and with the addition of various amounts of $C_6F_{14}$ as direct contact heat transfer liquids so as to determine the degree of migration of contaminant toxins from the heat transfer liquid through the plasma containers to the plasma being frozen. The test results are summarized in Table I. As seen therein, it has been determined that the above objectives can be attained by a heat transfer liquid comprising the commercially pure chlorofluorocarbon 1,1,2 trichloro-1,2,2 trifluoro-ethane (Freon 113), herein referred to as CFC 113, alone or in a mixture with various proportions of the fluorocarbon perfluorohexane ($C_6F_{14}$). Other fluorocarbons having chemically similar properties to $C_6F_{14}$ are alos believed suitable for addition to the CFC 113 and include perchloropentane ($C_5F_{12}$), perfluoromethylcyclohexane ($C_7F_{14}$), perfluoroheptane ($C_7F_{16}$), perfluoromonomethyldimethylcyclohexanes ($C_7F_{14}/C_8F_{16}$), perfluorodecaline isomers ($C_{10}F_{18}$), mixed perfluorodecalin and methyldecalin isomers ($C_{10}F_{18}+C_{11}F_{20}$), and perfluorinated polyethers ($[OCF(CF_3)CF_2]_n$—$(OCF_2)_m$). These fluorinated hydrocarbons are all commercially available under the FLUTEC trademarks of ISC Chemicals Limited. A particularly suitable composition comprises a mixture of from 0.5% to 2.0% by weight of perfluorohexane ($C_6F_{14}$) and the remainder CFC 113 (1,1,2 trichloro 1,2,2 trifluoro ethane) with the surprising result of a substantial reduction in the amounts of toxins which migrated to plasma through plastic bags immersed in the liquid mixture.

By the selective use of mixtures of the above compositions, toxin migration through the walls of the plastic bags or bottles ordinarily used to freeze plasma may be kept to a tolerable level despite the direct contact of the liquid heat transfer fluid with the bags or bottles. Since water is not miscible in the heat transfer liquid, ice does not form on the evaporation cooling coils immersed in the liquid. Freezing times of about 30 minutes for plasma bags immersed in liquid maintained at −35° C. are made possible by use of the liquid heat transfer fluids disclosed herein as compared with typical prior art freezing times in air freezers of about three to four hours. FIG. 1 shows typical freezing rates for plasma bags.

The tests performed for which the results are summarized in Table I are set forth in the following Examples.

EXAMPLE 1

Room Temperature Test for Migration of CFC 113 through Plastic Bags and Bottles to Plasma Tests were run on standard 650 milliliter capacity PVC bags having a wall thickness of 2 mils and on standard 850 ml. capacity polypropylene bottles having a wall thickness of 4 mils. The bags and bottles were filled with plasma and were immersed in pure CFC 113 at, a temperature of 22° C. for 45 minutes to determine ppm migration of CFC 113. Gas chromatography testing of the plasma revealed that 21 parts per million (ppm) of CFC 113 had migrated through the bag walls to the plasma and that 12 ppm had migrated through the thicker walls of the bottles to the plasma contained therein.

EXAMPLE 2

Freezing Temperature Test for Migration of CFC 113 through Plastic Bags and Bottles to Plasma This test was performed with the same parameters as Example 1 except that the temperature of the CFC 113 bath in which the bags and bottles of plasma were immersed was maintained at the lower temperature of −30° C. during the test. Analysis of the plasma in the bags revealed that only 10 ppm of CFC 113 was present therein and that only 5 ppm was present in the plasma which had been placed in the polypropylene bottles.

EXAMPLE 3

Room Temperature Test for Migration of Components of 99/1 Weight Mixture of CFC 113 and $C_6F_{14}$ through Plastic Bags and Bottles to Plasma The procedure of Example 1 was repeated using a bath comprising a 99 parts CFC 113 and 1 part by weight $C_6F_{14}$ mixture in the immersion bath. Only 15 ppm of CFC 113 were found to have migrated through the walls of the plastic bags to the plasma and only 9 ppm had migrated through the walls of the bottles.

EXAMPLE 4

Freezing Temperature Test for Migration of Components of 99/1 Weight Mixture of CFC 113 and $C_6F_{14}$ through Plastic Bags and Bottles to Plasma The same procedure used in Example 3 was followed except that the immersion bath temperature was maintained at −30° C. during the testing. Testing of the plasma revealed a migration through the bag walls of 7 ppm of CFC 113 and a migration through the bottle walls of 2 ppm CFC 113.

EXAMPLE 5

Room Temperature Test for Migration of Components of 95/5 Weight Mixture of CFC 113 and $C_6F_{14}$ through Plastic Bags and Bottles to Plasma The procedure of Example 3 was followed but using an immersion bath comprising a mixture as set forth above. Test results showed 12 ppm of CFC 113 migration through the bags and 7 ppm migration through the bottles.

EXAMPLE 6

Freezing Temperature Test for Migration of Components of 95/5 Weight Mixture of CFC 113 and $C_6F_{14}$ through Plastic Bags and Bottles to Plasma The tests were performed like Example 4, except the proportions of the components of the freezing bath were altered to 95 parts by weight of CFC 113 and 5 parts by weight of $C_6F_{14}$. The test results indicated that slight increases in the $C_6F_{14}$ proportion further lowered the amount of CFC 113 migration through the container walls to 6 ppm through the bag walls and to 1 ppm through the bottle walls.

EXAMPLE 7

Room Temperature Test for Migration of Components of 99.5/0.5 Weight Mixture of CFC 113 and $C_6F_{14}$ through Plastic Bags and Bottles to Plasma The test results using this mixture of components in the immersion bath revealed 18 ppm migration of CFC 113 through the bags and 11 ppm through the bottles.

EXAMPLE 8

Freezing Temperature Test for Migration of Components of 99.5/0.5 Weight Mixture of CFC 113 AND $C_6F_{14}$ through Plastic Bags and Bottles to Plasma The results of this test revealed 9 ppm of CFC 113 had migrated to the plasma through the bags and 3 ppm had migrated to the plasma through the bottles.

No detectable amount of $C6F_{14}$ were found in any of the plasma samples.

FIG. 1 shows plasma temperature vs time for plasma samples immersed in the 99/1 weight mixture of Example 4 and, for comparison, in a typical prior art mixture of 50% alcohol and 50% glycerol. As can be seen therein, the freezing times are drastically reduced by use of the mixture and process of Example 4. The plateau reached at 0° C. is greatly reduced by using liquids as disclosed and claimed herein. This reduction of crystallization time is believed to result in less damage during freezing of the recoverable fractions in the plasma.

FIG. 2 shows the graphical relationship between CFC 113 concentration in plasma frozen in blood-plasma pooling bags versus temperature for a 45 minute immersion. The mathematical equation which expresses the relationship is $$\ln C = -811.51/T + 5.639$$

where ln=natural log

C=CFC 113 concentration in ppm by wt.

T=C+273.2 C.

It has also been found that the yield of useful blood soluble proteins recovered from the frozen plasma by subsequently performed known freeze drying processes increases by about 10% which is believed due to the ultra rapid freezing made possible by direct contact immersion of the plasma bags in the heat transfer liquids disclosed herein.

From the foregoing description it will be seen that mixtures of the chlorofluorocarbon Freon 113 (CFC 113) and small amounts ranging from 0.5–5.0 weight percent of certain fluorocarbons, particularly $C_6F_{14}$, therewith results in compositions having properties which render them particularly suitable as a heat transfer liquid for direct contact freezing of plasma bags. Careful control of the mixed amounts of $C_6F_{14}$ enables variation of the freezing point of the heat transfer liquid so that the time of the freezing process can easily be reduced when desired by using a liquid with a suitably low freezing point and maintaining the liquid temperature near its freezing point while immersion or spray contacting the plasma containers therewith.

It should be noted that the fraction of $C_6F_{14}$ which has migrated throuth the container walls is nil, and that the CFC 113 fraction which has migrated is within tolerable levels. Since the vapor pressure of CFC 113 is thirty-fold higher than that of water, freeze drying of plasma in typical vacuum freeze dryers draws off substantially all of the CFC 113 fraction which remains after the direct contact freezing of the plasma. Precipitation products such as Factor 8 which is a life sustaining staple to the hemophiliac population of the world prepared from plasmas frozen as tought herein are sufficiently free of CFC 113 toxin that maximum patient intravenous exposure to CFC 113 is well under one gram per year assuming worst case conditions.

TABLE 1

| | Substance | Freezing Temp. | Boiling Temp. | Room Temperature Migration | | Freezing Temperature Migration | |
|---|---|---|---|---|---|---|---|
| | | | | 2 Mil PVC Bag | 4 Mil Bottle | 2 Mil PVC Bag | 4 Mil Bottle |
| (1) | CFC 113 | −35° C. | 47.6° C. | 21 ppm | 12 ppm | 10 ppm | 5 ppm |
| (2) | 99 Parts (WT.) CFC 113<br>1 Part (WT.) $C_6F_{14}$ | −36° C. | 48.1° C. | 15 ppm | 9 ppm | 7 ppm | 2 ppm |
| (3) | 95 Parts (WT.) CFC 113<br>5 Parts (WT.) $C_6F_{14}$ | −39° C. | 49.1° C. | 12 ppm | 7 ppm | 6 ppm | 1 ppm |
| (4) | 99.5 Parts (WT.) CFC 113<br>0.5 Parts (WT.) $C_6F_{14}$ | −36° C. | 47.9° C. | 18 ppm | 11 ppm | 9 ppm | 3 ppm |

We claim:

1. A process of freezing plasma comprising the steps of exposing thin wall containers of plasma to be frozen to direct contact with a heat transfer liquid selected from the group consisting of the chlorofluorocarbon 1,1,2 trichloro-1,2,2 trifluoro-ethane (CFC 113) and mixtures of the chlorofluorocarbon 1,1,2 trichloro-1,2,2 trifluoro-ethane (Freon 113), and at least one of the fluorocarbons perfluoropentane ($C_5F_{12}$), perfluorohexane ($C_6F_{14}$), perfluoromethylcyclohexane ($C_7F_{14}$), perfluoroheptane ($C_7F_{16}$), perfluoromonomethyldimethylcyclohexanes ($C_7F_{14}/C_8F_{16}$), perfluorodecalin isomers ($C_{10}F_{18}$), mixed perfluorodecalin and methyldecalin isomers ($C_{10}F_{18}+C_{11}F_{20}$), and perfluorinated polyethers ($[OCF(CF_3)CF_2]_n$—$(OCF_2)_m$, and maintaining said liquid at a temperature sufficiently low enough to freeze said plasma in the desired amount of time.

2. The process of claim 1, wherein said plasma containers are plastic and are exposed to direct contact with said heat transfer liquid by immersing said containers in a bath of said liquid.

3. The process of claim 1, wherein said plasma containers are plastic and are exposed to direct contact with a continuous flow of heat transfer liquid over the surface of said containers.

4. The process of claim 1, wherein said heat transfer liquid is a mixture of said chlorofluorocarbon and perfluorohexane.

5. The process of claim 4, wherein said heat transfer liquid comprises from 0.5 to 5.0 percent by weight of perfluorohexane.

6. The process of claim 4, wherein said heat transfer liquid comprises from 0.5 to 1.5 percent by weight of perfluorohexane.

7. The process of any one of the preceding claims, wherein said heat transfer liquid is maintained at a temperature of −30° C. or below.

* * * * *